US006238184B1

(12) United States Patent
Giribaldi

(10) Patent No.: US 6,238,184 B1
(45) Date of Patent: May 29, 2001

(54) AXIAL FAN, PARTICULARLY FOR MOTOR VEHICLES

(75) Inventor: Andrea Giribaldi, Asti (IT)

(73) Assignee: Gate S.p.A., Turin (IT)

( * ) Notice: Subject to any disclaimer, the term of this patent is extended or adjusted under 35 U.S.C. 154(b) by 0 days.

(21) Appl. No.: 09/280,825

(22) Filed: Mar. 30, 1999

(30) Foreign Application Priority Data

Mar. 30, 1998 (IT) ..... TO98A0276

(51) Int. Cl.[7] ..... F01D 5/22

(52) U.S. Cl. ..... 416/189; 416/223 R; 416/DIG. 2; 416/DIG. 5

(58) Field of Search ..... 416/169 A, 189, 416/192, 223 R, 228, 238, 243, DIG. 2, DIG. 5

(56) References Cited

U.S. PATENT DOCUMENTS 4,684,324 8/1987 Perosino .
5,624,234 4/1997 Neely et al. .
5,906,179 * 5/1999 Capdevila ..... 123/41.49

FOREIGN PATENT DOCUMENTS 43 26 147 11/1994 (DE) .
0 192 653 B1 4/1993 (EP) .
WO 91 07593 5/1991 (WO) .

* cited by examiner

*Primary Examiner*—Edward K. Look
*Assistant Examiner*—James M McAleenan
(74) *Attorney, Agent, or Firm*—Sughrue, Mion, Zinn, Macpeak & Seas, PLLC

(57) ABSTRACT

The fan comprises a central hub and a plurality of blades extending radially from the hub and each having a root portion adjacent the hub, a radially intermediate portion, and a radially outermost, tip portion. In the tip portion, the leading edge of each blade is inclined forwardly in the direction of rotation of the fan; in the root portion, the leading edge of each blade is inclined forwardly.

4 Claims, 2 Drawing Sheets

AXIAL FAN, PARTICULARLY FOR MOTOR VEHICLES

BACKGROUND OF THE INVENTION

The present invention relates to an axial fan, particularly for motor vehicles.

More specifically, the subject of the invention is an axial fan of the type comprising:

a central hub, and a plurality of blades extending radially from the hub and each having:

a root portion adjacent the hub, a radially intermediate portion, and a radially outermost, tip portion, the leading edge of the blade in the tip portion being inclined forwardly in the direction of rotation of the fan.

Axial fans of this type are known, for example, from U.S. Pat. No. 4,684,324 and from European patent EP-A-0 192 653.

In the axial fans described in these documents, the leading edge of each blade is inclined rearwardly relative to the direction of rotation of the fan in the root portion of the blade adjacent the hub, and is inclined forwardly in the direction of rotation of the fan in the remaining, radially outer portion of the blade.

In these fans, it has been found that air turbulence arises in the region of the intersection of the blades with the hub and this turbulence adversely affects the performance of the fan.

SUMMARY OF THE INVENTION

The object of the present invention is to provide an axial fan of the above-mentioned type which has improved performance and in which the flow-dynamic recirculation in the region of the intersection of the blade with the hub is optimized.

This and other objects are achieved, according to the invention, by an axial fan the main characteristics of which are defined in appended claims.

BRIEF DESCRIPTION OF THE DRAWINGS

Further characteristics and advantages of the invention will become clear from the following detailed description, given purely by way of non-limiting example with reference to the appended drawings, in which.

DETAILED DESCRIPTION OF THE INVENTION

Figure 1:
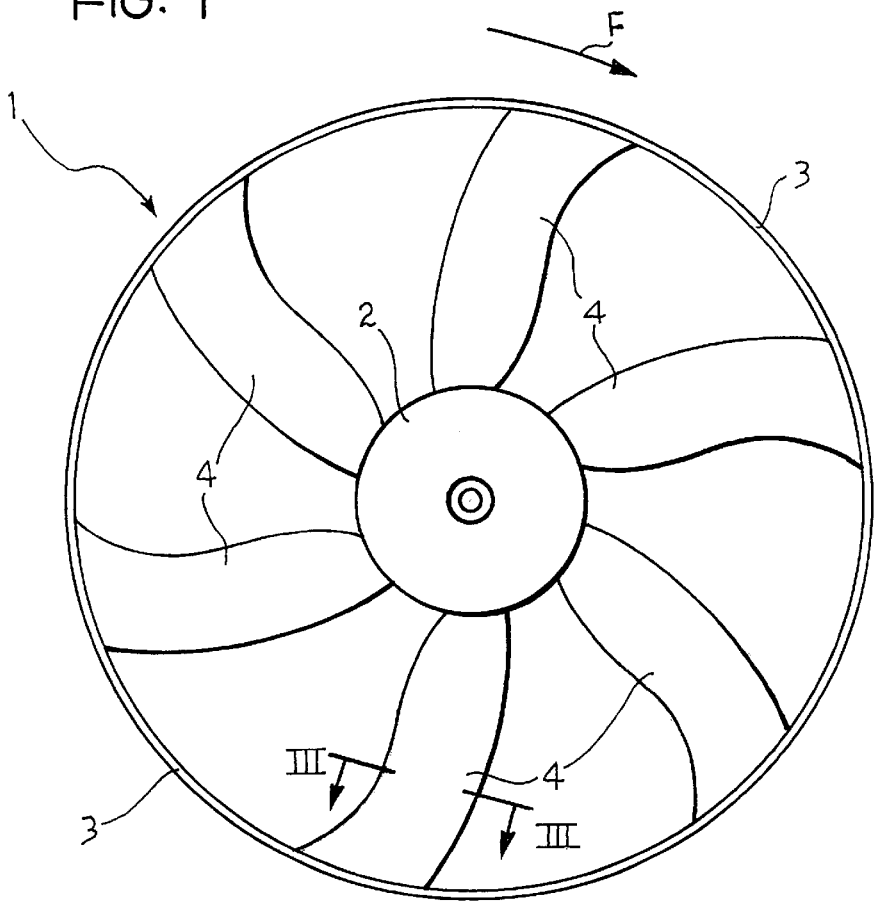
FIG. 1 is a front view of an axial fan according to the invention, seen from the upstream side in the direction of the air-flow.
Figure 2:
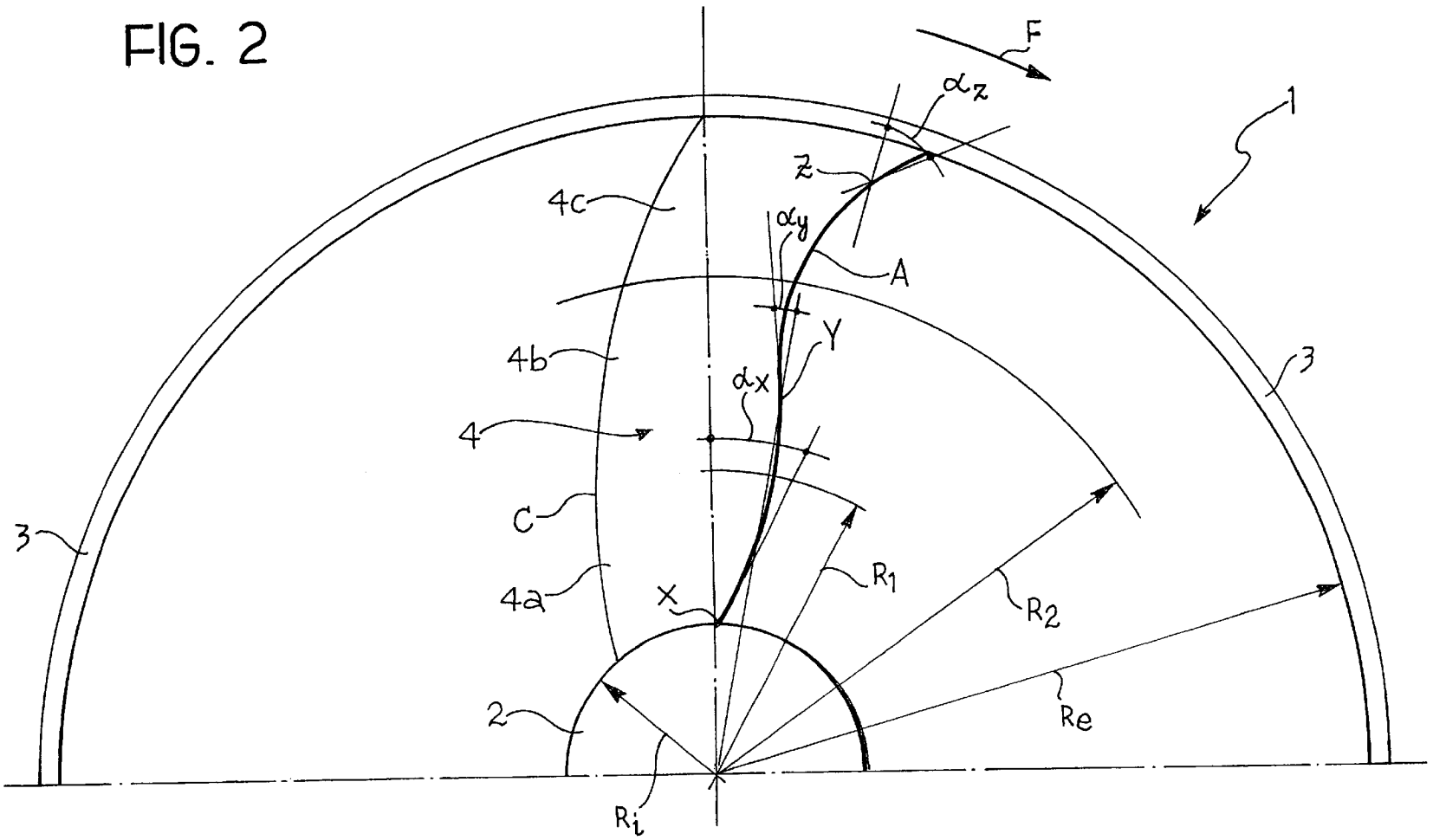
FIG. 2 is a partial view showing a fan according to the invention, on an enlarged scale.

With reference to FIGS. 1 and 2, an axial fan 1 according to the invention comprises a central hub 2, an outer ring 3 concentric with the hub 2, and a plurality of blades 4 which extend between the hub 2 and the ring 3.

Each blade extends from a cross-section at its origin situated adjacent the outer cylindrical surface of the hub 2, which has a radius $R_i$, as far as the inner cylindrical surface of the ring 3, which has a radius $R_e$.

In the front views of FIGS. 1 and 2, each blade 4 is defined by a line A which constitutes the frontal projection of the leading edge of the blade and by a line C which constitutes the frontal projection of the trailing edge of the blade.

The fan is intended to be driven in the direction of rotation indicated by the arrow F of FIGS. 1 and 2.

As can be seen in FIG. 2 in particular, each blade 4 can be divided basically into three successive portions: a root portion 4*a* adjacent the hub 2, a radially intermediate portion 4*b*, and a radially outermost, tip portion 4*c* adjacent the ring 3.

In the root portion 4*a* of each blade 4, the leading edge A is inclined forwardly in the direction of rotation F of the fan 1. In other words, the angle of inclination (the skew angle), defined as the angle which, at any point of the leading edge, is formed between the radial direction and the local tangent, is positive in the direction of rotation F.

The skew angle of the leading edge of each blade adjacent the hub 2 is advantageously greater than or equal to 10° and is preferably between 20° and 35°.

In the radially intermediate portion 4*b* of each blade, however, the leading edge A of each blade is inclined rearwardly relative to the direction of rotation of the fan 1.

Finally, in the tip portion 4*c*, the leading edge A of each blade is again inclined forwardly.

In FIG. 2 the skew angles $\alpha_x$, $\alpha_y$, $\alpha_z$ of the leading edge A at three points X, Y and Z belonging to the portions 4*a*, 4*b* and 4*c* of the blade 4, are indicated purely by way of example. In particular, the point X is situated adjacent the cylindrical outer surface of the hub 2.

The extent of the root portion 4*a* of each blade 4 in the radial direction is advantageously at most about ⅓ of the distance between the hub 2 and the outer ring 3. In other words, the root portion 4*a* of each blade 4 extends at most as far as a radial distance $R_1$ (from the axis of the hub 2) such that $R_1-R_i$ is at most equal to about $0.3\times(R_e-R_i)$.

The tip portion 4*c* of each blade 4 also preferably extends for about ⅓ of the distance between the hub 2 and the outer ring 3 in the radial direction. This tip portion 4*c* thus extends between the radial distance $R_e$ and a radial distance $R_2$ which is preferably such that $R_e-R_2$ is equal to about 0.3 $(R_e-R_i)$.

Figure 3:
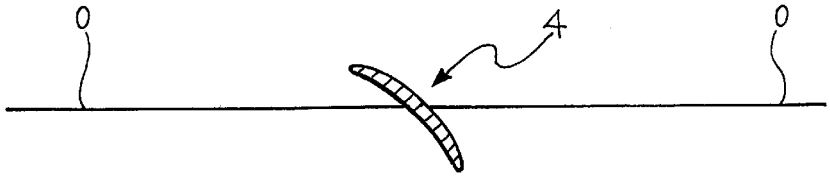
FIG. 3 is a section view taken on the line III—III of FIG. 1.

As shown in FIG. 3, each blade 4 is inclined out of the plane of rotation O—O of the fan 1.

The fan described above can advantageously be produced as a single piece of moulded plastics material.

Naturally, the principle of the invention remaining the same, the forms of embodiment and details of construction may be varied widely with respect to those described and illustrated purely by way of non-limiting example, without thereby departing from the scope of the invention as defined in the appended claims.

In particular, the invention is not limited to fans with outer rings but also applies to fans without such rings.

What is claimed is:

1. An axial fan comprising:

a central hub, and a plurality of blades extending radially from the hub and each having:

a root portion adjacent the hub, a radially intermediate portion, and a radially outermost, tip portion, the leading edge of each blade in the tip portion being inclined forwardly in the direction of rotation of the fan, in the root portion the leading edge of each blade being inclined forwardly in the direction of rotation of the fan and, in the intermediate portion, the leading edge being inclined rearwardly, wherein the skew angle of the leading edge in the root portion of each blade adjacent the hub is between 20° and 35°, and wherein the root portion of each blade extends in the radial direction at most up to about ⅓ of the radial extent of the blade.

2. An axial fan according to claim 1, wherein in the root portion the leading edge of each blade has a convex curved shape.

3. An axial fan according to claim 1, wherein the blades are inclined relative to the plane of rotation.

4. A fan according to claim 1, comprising an outer ring which is coaxial with the hub and to which the distal ends of the blades are joined.

* * * * *